US007583170B2

(12) United States Patent
Gogeissl et al.

(10) Patent No.: US 7,583,170 B2
(45) Date of Patent: Sep. 1, 2009

(54) SWITCHING DEVICE WITH SWITCH LATCH

(75) Inventors: Christian Gogeissl, Bad Kötzting/Arndorf (DE); Manuela Lüftl, Amberg (DE); Ludwig Niebler, Laaber (DE)

(73) Assignee: Siemens Aktiengesellschaft, Munich (DE)

( * ) Notice: Subject to any disclaimer, the term of this patent is extended or adjusted under 35 U.S.C. 154(b) by 175 days.

(21) Appl. No.: 11/900,340

(22) Filed: Sep. 11, 2007

(65) Prior Publication Data

US 2008/0079518 A1 Apr. 3, 2008

(30) Foreign Application Priority Data

Sep. 29, 2006 (EP) ..... 06020611

(51) Int. Cl.
*H01H 73/12* (2006.01)

(52) U.S. Cl. ..... 335/17; 335/21; 335/22; 335/23; 335/167; 335/172; 335/173

(58) Field of Classification Search ..... 335/6, 335/17, 21, 22, 23, 35, 36, 167–176
See application file for complete search history.

(56) References Cited

U.S. PATENT DOCUMENTS 4,598,183 A * 7/1986 Gardner et al. ..... 200/50.03
5,252,933 A * 10/1993 Kamino et al. ..... 335/172
6,307,455 B1 * 10/2001 Dolo et al. ..... 335/172
2004/0008098 A1 * 1/2004 Emura et al. ..... 335/17

FOREIGN PATENT DOCUMENTS

FR 2 538 160 A1 6/1984

* cited by examiner

*Primary Examiner*—Ramon M Barrera

(57) ABSTRACT

There is described a switching device whose disconnection cause can be identified, and a method for displaying the disconnection cause of a switching device. The switching device has a switch latch for mechanical activation of the switching device, a first tripper for overload protection, a second tripper for short-circuit protection, and a handle for activating the switch latch. The switching device is embodied in such a way that the handle is moved to a first position or a second position if the first tripper or second tripper is tripped, with the first position and the second position being different.

18 Claims, 3 Drawing Sheets

SWITCHING DEVICE WITH SWITCH LATCH

CROSS REFERENCE TO RELATED APPLICATIONS

This application claims priority of European application No. 06020611.7 EP filed Sep. 29, 2006, which is incorporated by reference herein in its entirety.

FIELD OF INVENTION

The invention relates to a switching device comprising a switch latch for mechanical activation of the switching device, a first tripper for overload protection, a second tripper for short-circuit protection, and a handle for activation of the switch latch, and to a method for displaying the disconnection cause of a switching device of said kind.

BACKGROUND OF INVENTION

In order to protect electrical loads, e.g. motors, use is routinely made of a circuit breaker having a tripper with time delay for overload protection and a tripper without time delay for short-circuit protection. Because the switch latch of the circuit breaker is mechanically coupled to the trippers, the trippers can interrupt the circuit by opening switching contacts automatically and effect the disconnection of the electrical load. The switching contacts can also be opened or closed manually by means of a handle of the circuit breaker, the handle being mechanically coupled to the switch latch or integrated in the switch latch. At the same time, the ON state (circuit breaker switched on) and the OFF state (circuit breaker switched off) are visible by virtue of the position of the handle.

It is already known that a circuit breaker has a handle which is arranged outside of the switch housing. The handle is moved to an intermediate position, also known as a tripped position, between ON and OFF positions if the circuit breaker is disconnected by a tripper in order to protect against overload or short circuit. In this case only the disconnection of the circuit breaker is shown by the position of the handle, but it is not possible to distinguish between overload and short circuit. In order to make the cause identifiable, the tripper that caused the trip is visibly indicated in some devices by means of a lamp, an attachable add-on module, or an integrated additional display. The use of an attachable add-on module or an integrated additional display is unfavorable in terms of the manufacturing costs of circuit breakers and hinders the simplification of the structure or the miniaturization of the size of circuit breakers.

SUMMARY OF INVENTION

The invention addresses e.g. the problem of visibly differentiating between the disconnection causes of a switching device.

The problem can be solved by means of a switching device as claimed in independent claims and by means of a method as claimed in a further independent claim. The dependent claims describe further advantageous embodiments of the invention.

The invention addresses the problem of indicating the trip cause by means of the position of the handle in a switching device. Assuming a switching device which has a switch latch for mechanical activation of the switching device, a first tripper for overload protection, a second tripper for short-circuit protection and a handle for activation of the switch latch, in order to indicate the disconnection cause of the switching device, the switching device is embodied in such a way that the handle is moved to a first position if the first tripper is tripped due to an overload, and the handle is moved to a second position if the second tripper is tripped due to a short circuit, with the first and the second positions being different. In the case of a disconnected switching device it is thus possible to make the trip cause identifiable in a simple manner and without an additional display. It is also unnecessary to provide additional space for further display elements on the small visible surface on the switch housing.

According to an advantageous embodiment of the invention, the handle for manually activating the switching device is provided. In this case the handle for activation of the switch latch is embodied in such a way that the switching device is switched on if the handle is moved to a third position, and that the switching device is switched off if the handle is moved to a fourth position. All four positions are different. If the switching device is used in a switch cabinet, a housing or similar, in addition to the ON and OFF state, the disconnection reasons of the switching device are also indicated by the position of the handle externally on the switch cabinet door or the housing.

In an advantageous embodiment the switching device is embodied in such a way that the handle arrives at the four positions by means of a rotational movement. Each of the four positions can be represented by a symbol or a sign and arranged in a circle, for example, in the case of a rotatable handle. The handle can come to rest in any position as a result of a rotational movement, and indicate the states and disconnection causes of the switching device.

The switching device advantageously has a switch gearwheel which is embodied to produce the rotational movement of the handle. By virtue of the switch gearwheel the rotational movement of the handle can be transferred to the switch latch or vice versa.

According to a further advantageous embodiment of the invention, the switch latch is embodied in such a way that the handle is moved to the first position and locked in the first position when the first tripper is tripped, and is moved to the second position and locked in the second position when the second tripper is tripped. The handle can also be moved to the third or fourth position and locked in the respective position when the switching device is switched on or off.

The handle advantageously has at least one toothed segment which is embodied in conjunction with the switch gearwheel to lock the handle in one of the four positions.

A switching device of said kind is normally used as a power switch or as a device which includes a power switch, in order to protect the current paths between an electrical supply and loads.

BRIEF DESCRIPTION OF THE DRAWINGS

The invention is described and explained in greater detail below with reference to the exemplary embodiments that are illustrated in the figures, in which.

DETAILED DESCRIPTION OF INVENTION

Figure 1:
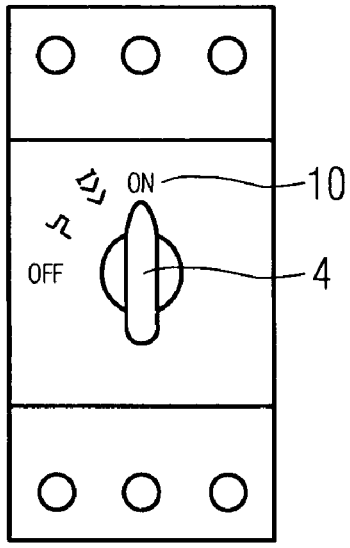
FIG. 1 shows an illustration of the handle of a switching device which has been switched on, FIG. 2 shows an illustration of the handle of a switching device which has been tripped due to short circuit.
Figure 2:
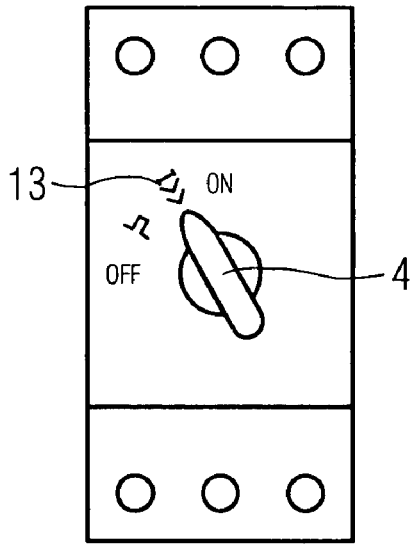
Figure 3:
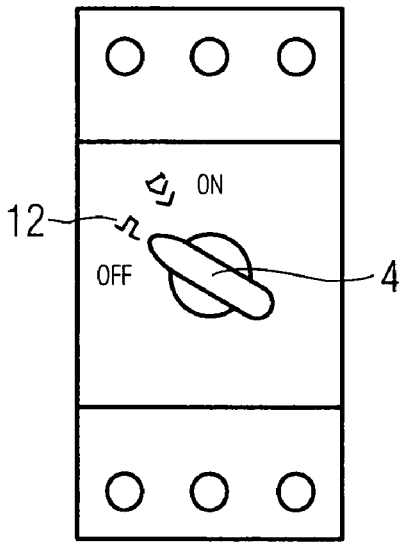
FIG. 3 shows an illustration of the handle of a switching device which has been tripped due to overload.
Figure 4:
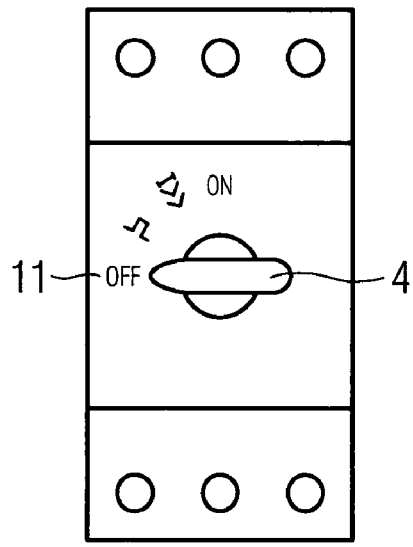
FIG. 4 shows an illustration of the handle of a switching device which has been switched off.

FIGS. 1 to 4 show in each case a handle 4 of a switching device which is used for the protection of an electrical load, e.g. a motor, against short circuit or overload. The switching device can also be switched on or off manually by rotating the handle 4. In order to visually indicate the switch states—switched on or off—and the disconnection cause (short circuit or overload) of the switching device, a total of four positions 10, 11, 12 and 13 are provided for the handle 4. The four positions 10, 11, 12 and 13 represent respectively the ON state, the OFF state, the disconnection due to overload and the disconnection due to short circuit for the switching device. The first position 12 and the second position 13 of the handle 4 are situated between the third position 10 and fourth position 11, with the angle of rotation of the handle 4 between the third position 10, in which the handle indicates the ON position of the device, and the fourth position 11, in which the handle 4 indicates the OFF position, being 90°. Each position 10, 11, 12 and 13 is also depicted differently by a symbol (or inscription) for greater ease of identification.

If the handle 4 is rotated to the ON position 10 (FIG. 1), the switching device is switched on. Conversely, if the handle 4 is rotated to the OFF position 11 (FIG. 4), the switching device is switched off. In addition, the handle 4 can automatically move to position 12 or 13 and be locked or held there (FIGS. 3 and 2) if the switching device automatically disconnects due to overload or short circuit. If the switching device is disconnected, e.g. due to overload, the handle 4 moves from the ON position 10, past the position 13 which indicates tripping due to short circuit, to the position 12 and is locked in this position 12 in order to prevent a further rotation to the OFF position 11. It is therefore possible, using the handle 4 alone, clearly to indicate the disconnection causes of the switching device in addition to the ON and OFF state, without any need to use an additional component.

Figure 5:
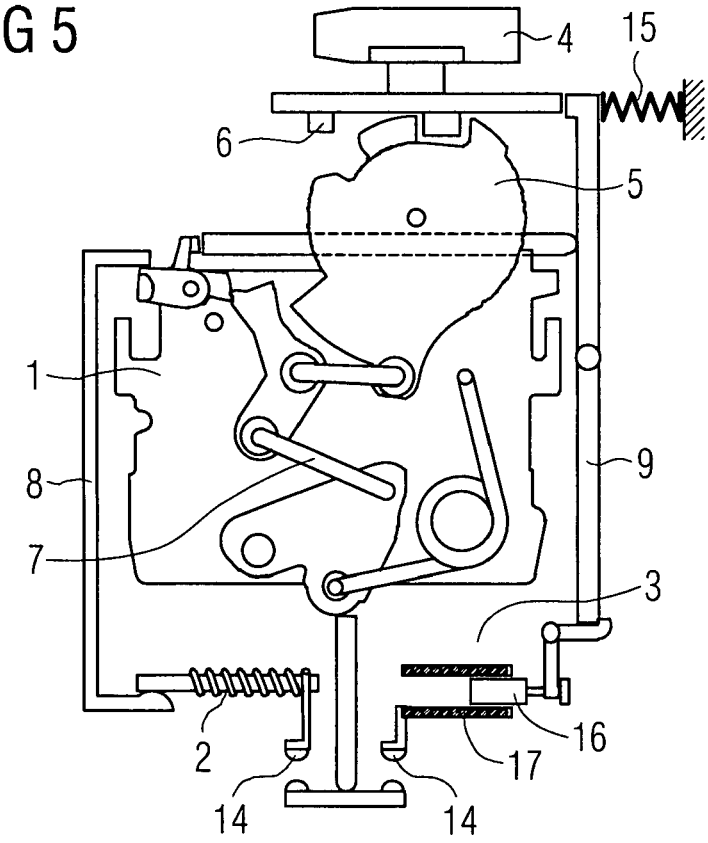
FIG. 5 shows a schematic illustration of the OFF state of the switching device.

FIG. 5 shows the schematic construction of a switching device as cited above which has been switched off. The switching device has a first tripper 2 for overload protection and a second tripper 3 for short-circuit protection. The first tripper 2 is preferably a thermobimetal tripper with time delay, and the second tripper 3 is preferably an electromagnetic tripper without time delay and additionally having a coil 17 and an armature 16. Furthermore, the switching device has a switch latch 1 for mechanical activation of moving contacts 14 of the switching device and a handle 4 for activating the switch latch 1. The handle 4 has a toothed segment 6, and the switch latch 1 comprises a switch gearwheel 5 which is mounted on a fixed spindle and at least one connection lever 7. By virtue of a toothed segment 6 engaging in the switch gearwheel 5, the handle 4 is mechanically coupled to the switch latch 1. The switch latch 1 is mechanically coupled to the trippers 2 and 3 respectively via two levers 8 and 9. A spring 15 is provided in order to exercise a force on the lever 9, such that the switch latch 1 can activate the trippers 2 and 3 or the handle 4 by means of its mechanical movement, the reverse applying analogously.

If the handle 4 is rotated to the position 11, the handle 4 engages in the switch gearwheel 5 by means of the toothed segment 6 and rotates the switch gearwheel 5. As a result of the rotation of the switch gearwheel 5, the switch latch 1 can open the switching contacts 14. The switching device is consequently switched off, and at the same time the handle 4 indicates the OFF state of the switching device in the OFF position 11.

Figure 6:
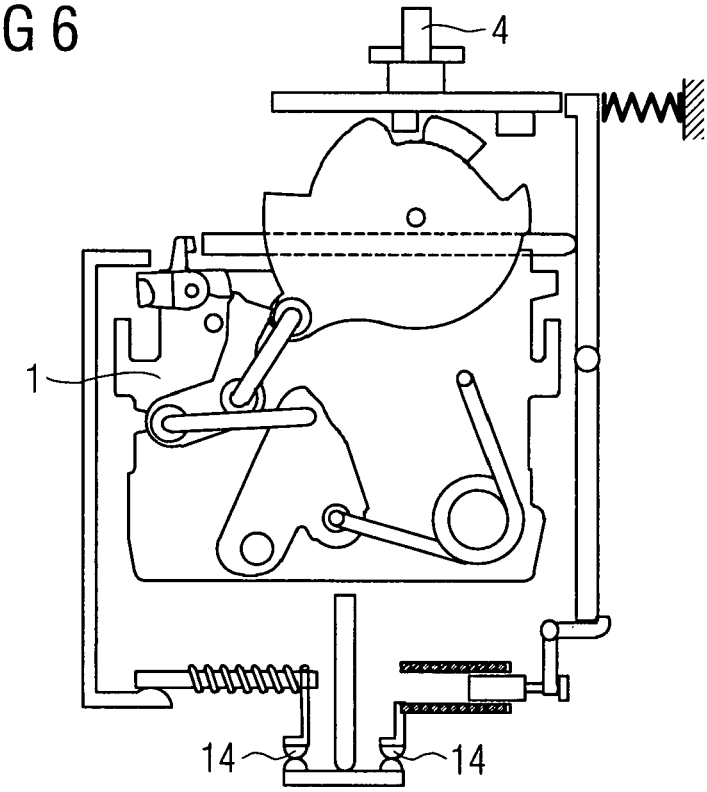
FIG. 6 shows a schematic illustration of the ON state of the switching device.

An identical switching device which is switched on is schematically illustrated in FIG. 6. If the handle 4 is rotated to the ON position 10, the handle 4 activates the switch latch 1 in the same way. The switching contacts 14 are closed in order to switch the switching device on again, while the handle 4 indicates the ON state of the switching device in the ON position 10.

Figure 7:
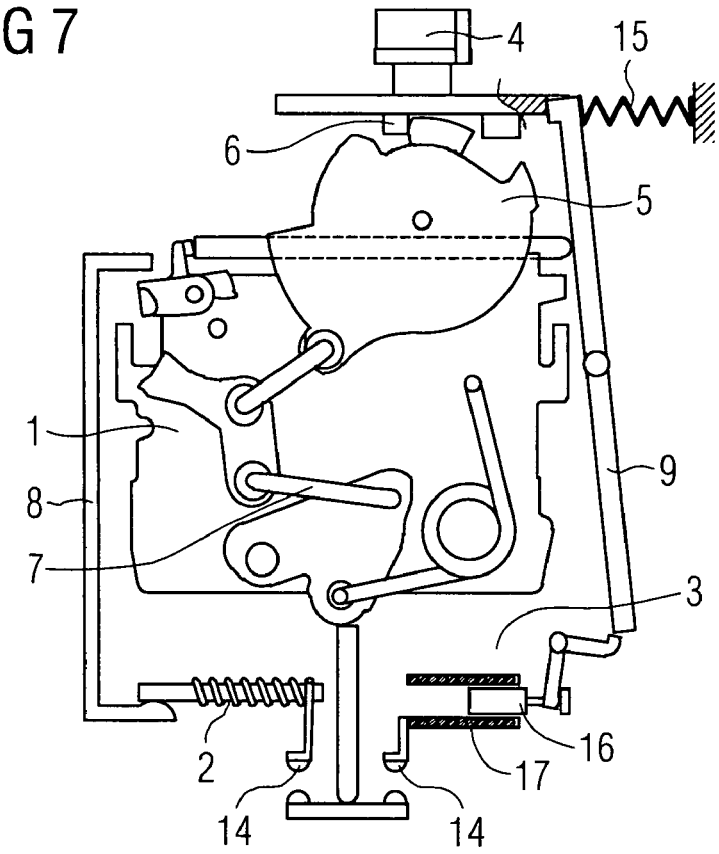
FIG. 7 shows a schematic illustration of the disconnection of the switching device due to short circuit.

In FIG. 7, the switching device has been disconnected due to a short circuit. In normal operation the lever 9 rests on the spring 15 and compresses the spring 15. In the case of a short circuit, the armature 16 plunges into the coil 17 of the tripper 3 and the lever 9 is consequently freed. The lever 9 is pressed against the handle 4 by the released spring force and locks the handle 4 in the position 13. At the same time the switching contacts 14 are opened via the switch latch 1. The switching device is thus disconnected and at the same time the handle 4 shows the disconnection cause as a short circuit in the position 13.

Figure 8:
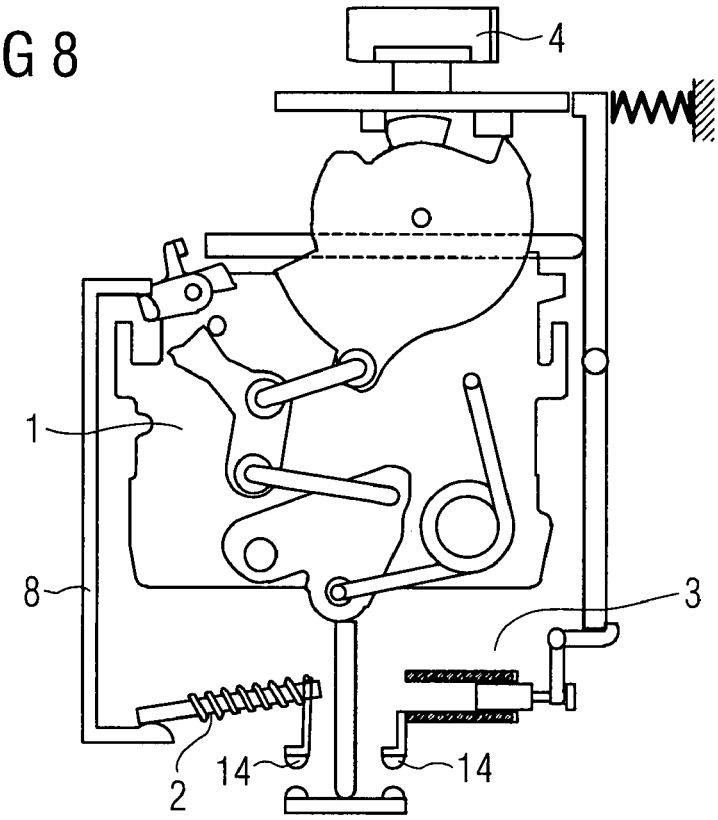
FIG. 8 shows a schematic illustration of the disconnection of the switching device due to overload.

In FIG. 8, the switching device has been disconnected due to an overload. In the case of overload, the bimetal of the tripper 2 heats up. As a result of the deflection of the bimetal, the switch latch 1 is activated via the lever 8. The handle 4, which is coupled to the switch latch 1, is moved to the position 12 by means of said switch latch 1 and locked there. The switching contacts 14 are then open. The switching device is thus disconnected and the handle 4 shows the disconnection cause as overload in the position 12.

The invention claimed is:

1. A switching device, comprising:

a switch latch for mechanical activation of the switching device;

a first tripper for overload protection;

a second tripper for short-circuit protection;

a handle for activation of the switch latch, wherein the handle is moved to a first position if the first tripper tripped, and wherein the handle is moved to a second position if the second tripper is tripped, wherein the first position and the second position are different.

2. The switching device as claimed in claim 1, wherein the handle is in a third position, when the switching device is switched on, wherein the handle is in a fourth position, when the switching device is switched off, and wherein the four positions are different positions.

3. The switching device as claimed in claim 2, wherein the handle is positioned in the four positions by a rotational movement.

4. The switching device as claimed in claim 3, further comprising a switch gearwheel to produce the rotational movement of the handle.

5. The switching device as claimed in claim 1, wherein the handle is moved to the first position and is locked in the first position when the first tripper is tripped, wherein the handle is moved to the second position and locked in the second position when the second tripper is tripped, wherein the handle is moved by the switch latch.

6. The switching device as claimed in claim 5, wherein the handle is locked in a third position, when the switching device is switched on, and wherein the handle is locked in a fourth position, when the switching device is switched off.

7. The switching device as claimed in claim 6, wherein the handle has a toothed segment connected with a switch gearwheel to lock the handle in one of four positions.

8. The switching device as claimed in claim 7, wherein the switching device is a power switch or a device which has a power switch.

9. The switching device as claimed in claim 1, wherein the handle has a toothed segment connected with a switch gearwheel to lock the handle in one of the positions.

10. A method to display a disconnection cause of a switching device, comprising:

providing the switching device having a first tripper for overload protection, a second tripper for short-circuit protection, a switch latch for mechanical activation of the switching device, and a handle for activation of the switch latch; and moving the handle to a first position if the first tripper is tripped;

moving the handle to a second position if the second tripper is tripped, wherein the first position and the second position are different.

11. The method as claimed in claim 10, wherein the switching device is switched on, if the handle is moved to a third position, wherein the switching device is switched off, if the handle is moved to a fourth position, and wherein the four positions are different.

12. The method as claimed in claim 11, wherein the handle is positioned in the four positions by a rotational movement.

13. The method as claimed in claim 12, wherein the rotational movement of the handle is excited by a switch gearwheel.

14. The method as claimed in claim 10, wherein the handle is moved to the first position and locked in the first position when the first tripper is tripped wherein the handle is moved to the second position and locked in the second position when the second tripper is tripped, wherein the handle is locked in the third position when the switching device is switched on, and wherein the handle is locked in the fourth position when the switching device is switched off.

15. The method as claimed in claim 14, wherein the handle is locked by a toothed segment of the handle.

16. A power switch, comprising:

a switch latch for mechanical activation of the power switch;

a first tripper for overload protection;

a second tripper for short-circuit protection;

a handle for activation of the switch latch, wherein the handle is moved to a first position if the first tripper tripped, and wherein the handle is moved to a second position if the second tripper is tripped, wherein the first position and the second position are different, wherein the handle is in a third position, when the switching device is switched on, wherein the handle is in a fourth position, when the switching device is switched off, and wherein the four positions are different positions.

17. The power switch as claimed in claim 16, further comprising a switch gearwheel to cause a rotational movement of the handle, wherein the handle is positioned in the four positions by the rotational movement, wherein the handle is moved to the first position and is locked in the first position when the first tripper is tripped, wherein the handle is moved to the second position and locked in the second position when the second tripper is tripped, wherein the handle is moved by the switch latch, wherein the handle is locked in a third position, when the switching device is switched on, and wherein the handle is locked in a fourth position, when the switching device is switched off.

18. The switching device as claimed in claim 17, wherein the handle has a toothed segment connected with a switch gearwheel to lock the handle in one of the positions, wherein the handle has a toothed segment connected with a switch gearwheel to lock the handle in one of the four positions, and wherein the switching device is a power switch.

* * * * *